US006808086B2

(12) United States Patent
Sasaguri et al.

(10) Patent No.: US 6,808,086 B2
(45) Date of Patent: Oct. 26, 2004

(54) PASTE EJECTION APPARATUS

(75) Inventors: Shinji Sasaguri, Fukuoka (JP); Mitsuru Ozono, Chikushino (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/671,906

(22) Filed: Sep. 25, 2003

(65) Prior Publication Data

US 2004/0069801 A1 Apr. 15, 2004

(30) Foreign Application Priority Data

Oct. 15, 2002 (JP) ..... P. 2002-300097
Mar. 27, 2003 (JP) ..... P. 2003-088448
Mar. 27, 2003 (JP) ..... P. 2003-088449

(51) Int. Cl.[7] ..... F04B 27/08

(52) U.S. Cl. ..... 222/137; 417/269; 417/470; 417/510; 417/512; 91/499

(58) Field of Search ..... 417/269, 470, 417/510, 512; 91/499; 222/136, 137, 138

(56) References Cited

U.S. PATENT DOCUMENTS 3,348,495 A * 10/1967 Orshansky, Jr. ..... 91/477
6,079,313 A * 6/2000 Wolcott et al. ..... 91/499
6,179,574 B1 * 1/2001 Yie ..... 417/269
6,206,649 B1 * 3/2001 Yie ..... 417/269

FOREIGN PATENT DOCUMENTS

JP 2-78773 6/1990
JP 2002-346462 12/2002

* cited by examiner

*Primary Examiner*—Kenneth Bomberg
(74) *Attorney, Agent, or Firm*—Pearne & Gordon LLP

(57) ABSTRACT

In a seal mechanism which constitutes a port switching portion in a pump mechanism of a paste ejection apparatus that ejects paste, and which prevents leakage of the paste from a seal portion between a plunger block rotating with a plunger and a fixed seal block (between a seal surface and a sliding surface), a housing portion is formed by opposing an outer surface provided for the seal block to an inner surface extending axially from the cylinder block, and a ring-shaped external seal member formed by combination of an O-ring and self-lubricant material such as PTFE is attached into the housing portion. Hereby, it is possible to prevent the paste that has leaked from the seal portion from leaking to the outside of the housing portion by the external seal member.

11 Claims, 13 Drawing Sheets

PASTE EJECTION APPARATUS

BACKGROUND OF THE INVENTION

The present invention relates to a paste ejection apparatus for ejecting slurry-like paste in which a viscous substance and a filler component are mixed, such as conductive paste.

As a method of joining electronic parts such as a semi-conductive chip to a print board or a lead frame, a resin adhesive is used much. As a kind of resin adhesive, conductive paste has been known, in which a conductive component such as metal powder is added in the resin thereby to apply conductivity to the joint. Since the conductive paste has a function of the adhesive, and also can cause the joint to conduct electrically, it is much used in order to secure a semi-conductive element onto the board and cause the semi-conductive element to conduct to an electrode of the board.

This conductive paste is obtained by mixing a main component as a resin adhesive such as epoxy resin, curing agent for curing the epoxy resin, or cure accelerator, with metal powder having conductivity. As the metal powder, silver powder is much used. The conductive paste is supplied in the shape of slurry in which silver powder having each kind of shape in order to improve the conductivity, for example, a grain-shaped silver powder or flake-shaped silver powder, is mixed with the resin adhesive.

For an applying apparatus of applying this conductive paste, an ejection apparatus for ejecting the conductive paste is provided. A plunger type ejection apparatus has been known, which sucks the conductive paste into a cylinder room and ejects it by a reciprocating movement of a plunger. Since the ejection by the reciprocating of the plunger is performed only intermittently, in case that it is necessary to perform paste applying of high efficiency by performing the ejection incessantly, a multi-plunger type paste apparatus having plural plungers is generally used, for example disclosed in JP-U-02-078773 (Japanese Utility Model Application Publication Number: Hei02-078773).

For such the multi-plunger type paste ejection apparatus, it is necessary to eject the paste ejected from the respective plungers in order from one fixed ejection port. Therefore, its ejection apparatus has aport switching function. Regarding this port switching, generally, an opening surface of a cylinder block for which a plunger hole is provided is brought into slide-contact with a fixed block for which an ejection port is provided, and the opening portion of each plunger is communicated with the ejection port in order. In this type, the slide-contacting surface between the opening surface of the cylinder block and the fixed block function as a seal portion for preventing the paste from leaking between the two members. Therefore, such paste leakage preventing measures are adopted that surface-finishing of high accuracy for this slide-contact surface in parts working in order to prevent occurrence of clearance, and use of a mechanism which applies the predetermined surface pressure at the operation time.

However, since the conductive paste is the slurry including a large amount of filler components such as silver powder and solid particles, in the conventional paste ejection apparatus, depending on constituent parts, the solid particles interposed between the slide clearance of the seal portion are easy to be attached onto the sliding surface, so that closeness of the sliding surface is hindered and it is not prevented that the paste leaks from the seal portion to the outside.

In addition, in such the paste ejection apparatus, the slurry-like liquid that is high in viscous and includes the metal powder is ejected. Therefore, since leakage of the liquid inside the ejection mechanism causes a bad operation and parts wear, the plunger sliding portion and the port switching portion require high sealing ability. However, generally to secure the high sealing ability increases sliding resistance of the plunger. Therefore, a load onto the drive mechanism which reciprocates the plunger increases, so that a large-sized drive mechanism is required. As described above, it was difficult to realize a compact paste ejection apparatus which secures the high sealing ability.

SUMMARY OF THE INVENTION

Therefore, an object of the invention is to provide a paste ejection apparatus which can prevent the paste from excessively leaking from the seal portion.

Furthermore, another object of the invention is to provide a small-sized and compact paste ejection apparatus which can secure the high sealing ability.

In accordance with the invention, there is provided a paste ejection apparatus for ejecting slurry-like paste in which a viscous substance and a filler component are mixed, comprising: a cylinder block being rotatable about a rotational axis by a rotation drive means, and contacting slidably with a seal surface of a seal member through a slide surface orthogonal to the rotational axis; plural cylinder holes provided in the direction of the rotational axis of the cylinder block and including opening portions formed at equal intervals on the same circumference of a circle having the rotational axis of the slide surface as a center; a plunger inserted into each cylinder hole; a plunger drive means reciprocating this plunger in synchronization with the rotation of said cylinder block; first and second communicating ports provided on the seal surface and communicating with the opening portions of the cylinder holes in the predetermined rotary position of the cylinder block; first and second external ports communicating respectively with the first and second communicating ports through the seal member; a housing portion located on the peripheral side of the seal surface, closed and surrounded by the seal member and the cylinder block to be a circular ring-shaped space; and a ring-shaped external seal member attached into the housing portion, including a first seal material having self-lubrication and a second seal material being rich in elasticity.

Furthermore, in the paste ejection apparatus according to the invention, the housing portion is formed by opposing an outer surface of the seal member to an inner surface extending axially from the cylinder block.

Furthermore, in the paste ejection apparatus according to the invention, the second seal material of the external seal member is fitted onto the outer surface of the seal member, and the first seal member of the external seal member slidably contacts with the inner surface of the cylinder block.

In another aspect of the invention, the housing portion is formed by opposing an inner surface extending axially from the seal member to an outer surface of cylinder block.

Furthermore, in the paste ejection apparatus according to the invention of the above aspect, the first seal member of the external seal member slidably contacts with the outer surface of the cylinder block, and the second seal material of the external seal member is fitted onto the inner surface of the seal member.

Preferably, the first seal member has a recess portion, and the second seal member is held by the recess portion of the first seal member.

In another aspect of the invention, the paste ejection apparatus comprises cylinder block being rotatable about a rotational axis by a rotation drive means, and contacting slidably with a seal surface of a seal member through a slide surface orthogonal to the rotational axis; plural cylinder holes provided in the direction of the rotational axis of the cylinder block and including opening portions formed at equal intervals on the same circumference of a circle having the rotational axis of the slide surface as a center; a plunger inserted into each cylinder hole; a plunger drive means reciprocating this plunger in synchronization with the rotation of said cylinder block; first and second communicating ports provided on the seal surface and communicating with the opening portions of the cylinder holes in the predetermined rotary position of the cylinder block; first and second external ports communicating respectively with the first and second communicating ports through the seal member; a housing portion located on the peripheral side of the seal surface, closed and surrounded by the seal member and the cylinder block to be a circular ring-shaped space; a ring-shaped external seal member attached into this housing portion; and a run-out constraining means for constraining run-out displacement in the diameter direction of the cylinder block near the external seal portion slidably contacts with the cylinder block.

Preferably, the housing portion is formed by opposing an outer surface of the seal member to an inner surface extending axially from said cylinder block; the inner surface side of the external seal member is fitted onto the outer surface of the seal member; and the outer surface side of the external seal member slidably contacts with the inner surface of the cylinder block.

In another aspect of the invention, the paste ejection apparatus for ejecting slurry-like paste in which a viscous substance and a filler component are mixed, comprises: a cylinder block being rotatable about a rotational axis by a rotation drive means, and contacting slidably with a seal surface of a seal member through a slide surface orthogonal to the rotational axis; plural cylinder holes provided in the direction of the rotational axis of the cylinder block and including opening portions formed at equal intervals on the same circumference of a circle having the rotational axis of the slide surface as a center; a plunger inserted into each cylinder hole; a plunger drive means reciprocating this plunger in synchronization with the rotation of said cylinder block; first and second communicating ports provided on the seal surface and communicating with the opening portions of the cylinder holes in the predetermined rotary position of the cylinder block; and first and second external ports communicating respectively with the first and second communicating ports through the seal member; furthermore the plunger drive means includes; a cam portion provided on the rotation drive means side of the cylinder block, and having cylindrical recess portions formed so that the drive end sides of the plural plungers can enter therein; a cam groove formed on the inner surface of said cylindrical recess portion and converting the relative rotating movement for the cam portion of said cylinder block into the reciprocating movement of the plunger in the direction of the rotational axis; and a cam follower coupled to the drive end side of each of the plural plungers, and rotating and moving into the cam groove thereby to transmit the reciprocating movement to the plunger.

Furthermore, the cam portion is constituted by combining two end cams each having a cam surface in the direction of the rotational axis in a state where the cam surfaces are opposed to each other.

According to the invention, on the peripheral side of the seal surface between the fixed seal member and the rotating cylinder block, the housing portion which is circular ring-shaped space closed and surrounded by the seal member and the cylinder block is provided, and the nearly ring-shaped external seal member comprising the self-lubricant material and the material that is rich in elasticity is attached into this housing portion, whereby it is possible to prevent the paste which has leaked from the seal surface from leaking to the outside of the housing by the external seal member.

Further, according to the invention, such the constitution is adopted that on the peripheral side of the seal surface between the fixed seal member and the rotating cylinder block, the housing portion which is circular ring-shaped space closed and surrounded by the seal member and the cylinder block is provided, the nearly ring-shaped external seal member is attached into this housing portion, and the run-out displacement is constrained in the diameter direction of this cylinder block near this external seal portion, whereby sealing ability when the paste that has leaked from the seal surface is prevented from leaking to the outside of the housing by the external seal member is improved, and wear of the external seal member can be reduced.

Further, according to the invention, as the plunger drive means for reciprocating the plural plungers, there are the cam portion which has therein cylindrical recess portions which the drive end sides of the plural plungers can enter; the cam groove for converting the rotating movement into the reciprocating displacement in the direction of the rotational axis, which is formed on the inner surface of the cylindrical recess portion; and the cam follower rotating and moving into this cam groove, which is coupled to the drive end side of the plunger, where by under the high sliding resistance condition, in either case of the going movement and the returning movement of the plunger, the drive power can be surely transmitted, high sealing ability is secured, and the dimension in the diameter direction can be reduced, so that a small and compact paste ejection apparatus is realized.

DESCRIPTION OF THE PREFERRED EMBODIMENT

First Embodiment

Figure 1:
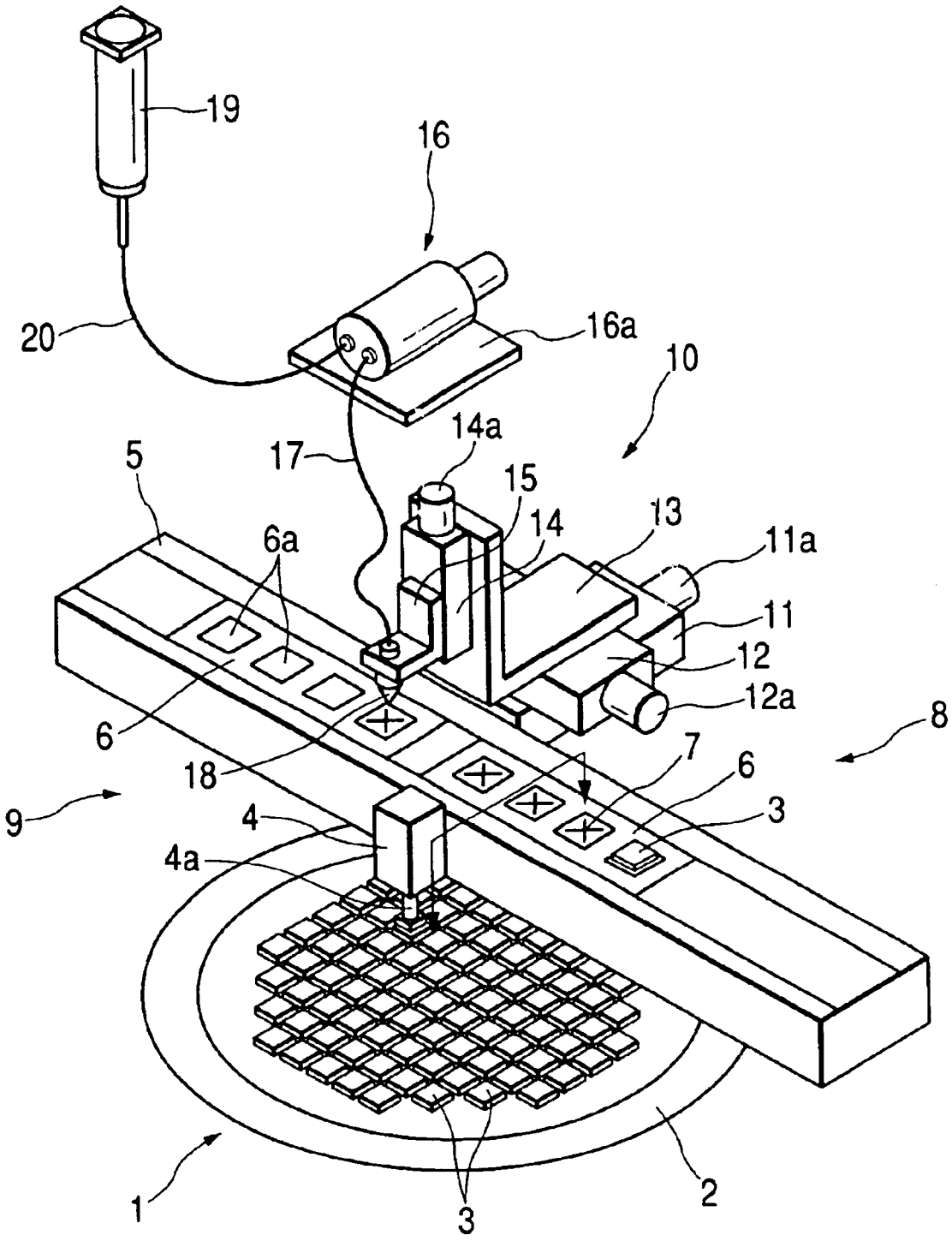
FIG. 1 is a perspective view of a die bonding apparatus according to a first embodiment of the invention.
Figure 2:
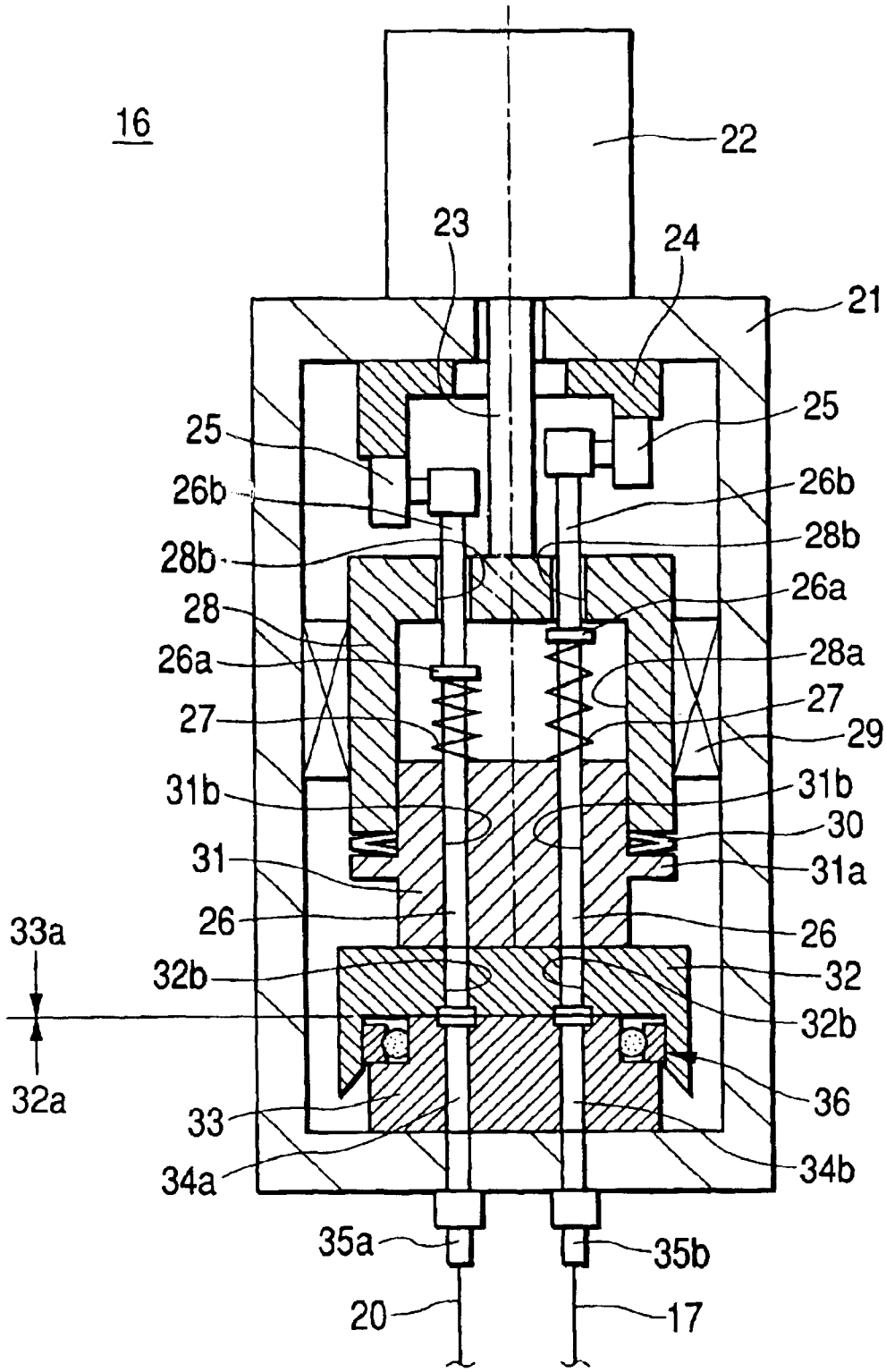
FIG. 2 is a sectional view of a paste ejection apparatus according to the first embodiment of the invention.
Figure 3:
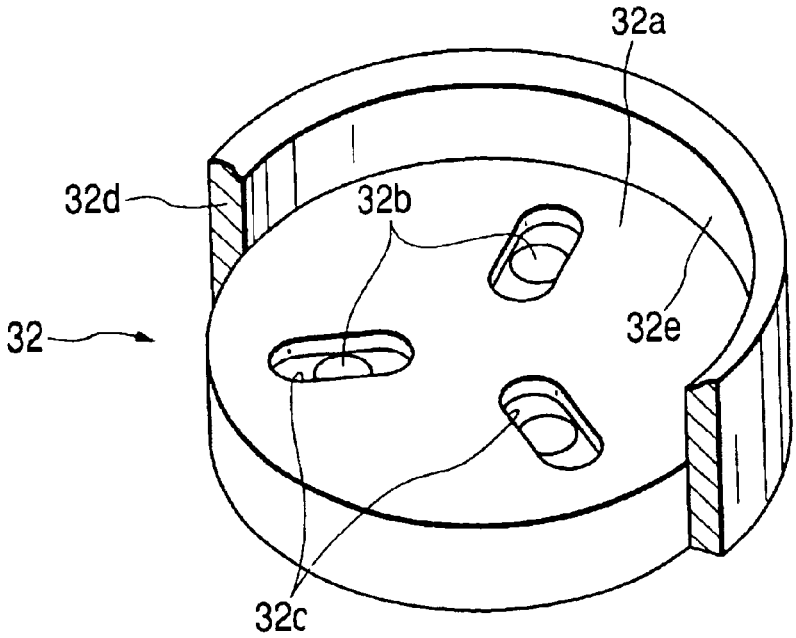
FIG. 3 is a perspective view of a plunger disc of the paste ejection apparatus according to the first embodiment of the invention.
Figure 4:
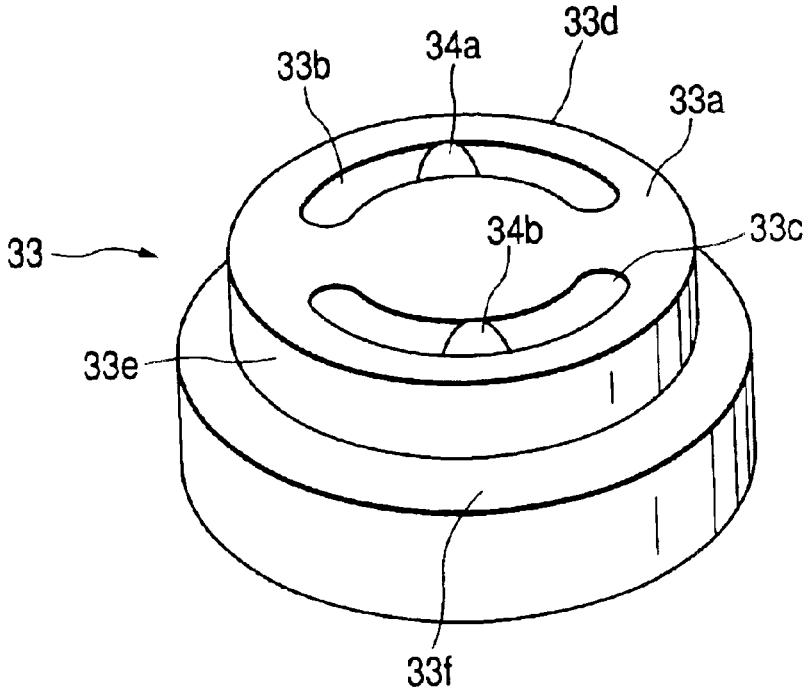
FIG. 4 is a perspective view of a seal disc of the paste ejection apparatus according to the first embodiment of the invention.
Figure 5:
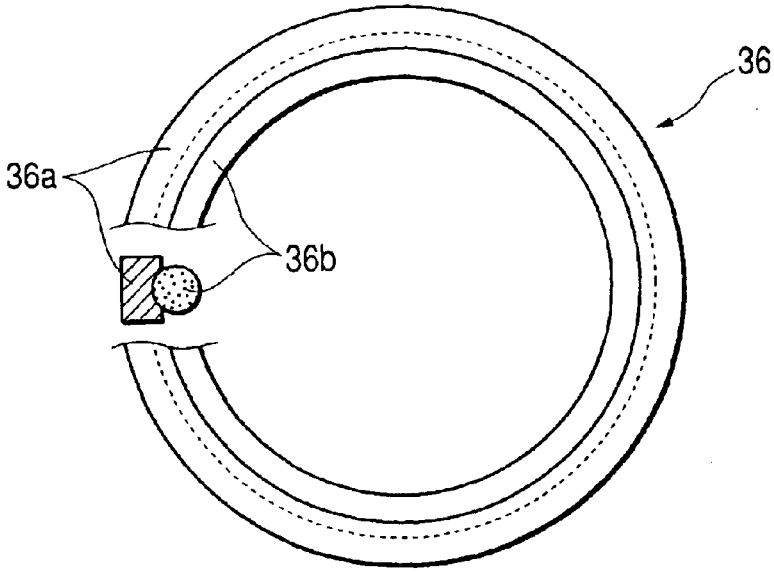
FIG. 5 is a diagram for explaining the shape of an external seal of the paste ejection apparatus according to the first embodiment of the invention.
Figure 6:
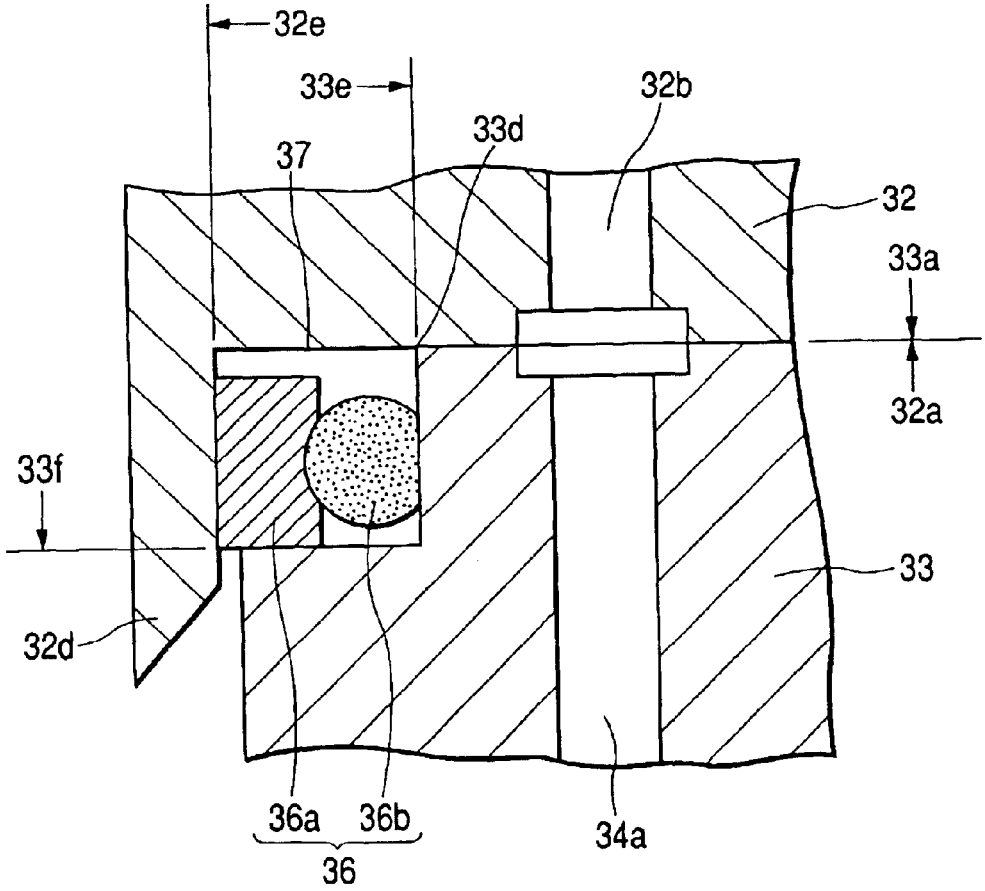
FIG. 6 is a diagram for explaining the attachment state of the external seal of the paste ejection apparatus according to the first embodiment of the invention.

FIG. 1 is a perspective view of a die bonding apparatus according to a first embodiment of the invention, FIG. 2 is a sectional view of a paste ejection apparatus according to the first embodiment of the invention, FIG. 3 is a perspective view of a plunger disc of the paste ejection apparatus according to the first embodiment of the invention, FIG. 4 is a perspective view of a seal disc of the paste ejection apparatus according to the first embodiment of the invention, FIG. 5 is a diagram for explaining the shape of an external seal of the paste ejection apparatus according to the first embodiment of the invention, FIG. 6 is a diagram for explaining the attachment state of the external seal of the paste ejection apparatus according to the first embodiment of the invention, and FIG. 7 is a diagram for explaining an operation of the paste ejection apparatus according to the first embodiment of the invention.

Referring first to FIG. 1, the structure of the die bonding apparatus will be described. In FIG. 1, on a chip supply portion 1, a wafer sheet 2 is held by a not shown holding table. To the wafer sheet 2, many chips 3 that are semiconductive elements are bonded. To a side of the chip supply portion 1, a transporting path 5 is arranged, which transports a lead frame 6 that is a substrate, and positions the lead frame 6 in a paste applying position and a bonding position. Above the chip supply portion 1, a bonding head 4 is arranged, which moves horizontally and vertically by a not shown moving mechanism.

On a side of the transporting path 5, a paste applying portion 9 is arranged. The paste applying portion 9 is so constituted that an applying nozzle 18 is attached to a moving table 10 through an L-shaped bracket 15. The applying nozzle 18 is coupled to a paste ejection apparatus 16 secured onto a fixed plate 16*a* by a tube 17 made of flexible material.

The paste ejection apparatus 16 is further coupled to a syringe 19 through a tube 20. Into the syringe 19, conductive paste (hereinafter simply referred to as paste) in which a viscous substance such as epoxy resin and a conductive filler component such as silver powder are mixed is stored. By driving the paste ejection apparatus 16, the paste into the syringe 19 is sucked and ejected by the paste ejection apparatus 16, and press-fed through the tube 17 to the applying nozzle 18. Next, the paste is ejected from an applying port provided for a lower end portion of the applying nozzle 18 and applied into an applying area 6*a* of the lead frame 6.

The moving table 10 comprises a Y-axis table 11, an X-axis table 12 placed on the Y-axis table 11, a Z-axis table 14 vertically coupled onto the X-axis table 12 through an L-shaped bracket 13. The Y-axis table 11, the X-axis table 12, and the Z-axis table 14 have respectively a Y-axis motor 11*a*, an X-axis motor 12*a*, and a Z-axis motor 14*a*. By driving the X-axis motor 12*a*, the Y-axis motor 11*a*, and the Z-axis motor 14*a*, the applying nozzle 18 moves on the lead frame 6 horizontally and vertically. Accordingly, the moving table 10 is a moving means for moving the applying nozzle 18 in relation to the lead frame 6.

A mounting position of the chip 3 on the upper surface of the lead frame 6 is the applying area 6*a* into which the paste 7 is applied. The applying nozzle 18 is located into the applying area 6*a*, and the applying nozzle 18 is moved while the paste 7 is being ejected from the applying nozzle 18, whereby the paste 7 for chip bonding is drawn and applied into the applying area 6*a* at a predetermined drawn pattern.

After this paste applying, the lead frame 6 is fed in a bonding position on the transporting path 5 and positioned. Next, on the paste 7 applied into the applying area 6*a*, the chip 3 picked up from the chip supplying portion 1 by a nozzle 4*a* of the bonding head 4 is bonded.

Referring next to FIG. 2, the structure of the paste ejection apparatus 16 will be described.

In FIG. 2, the paste ejection apparatus 16 is constituted so that a shaft type multi-plunger pump which is driven by a motor 22 used as a rotation drive means is included in an outer cylinder portion 21. To a rotary shaft 23 of the motor 22, a cylindrical rotator 28 is coupled. The rotator 28 is supported by a bearing 29 rotatably, and to an inner diameter portion 28*a* of the rotator 28, a plunger holder 31 is attached. The plunger holder 31 is permitted to slide in a direction of an rotational axis in relation to the rotator 28, and receives the rotation from the rotator 28.

To a leading end of the plunger holder 31, a plunger disc 32 is secured. The plunger holder 31 and the plunger disc 32 have respectively plural cylinder holes 31*b* and 32*b*, and each cylinder hole 31*b* and each cylinder hole 32 communicate with each other in the direction of the rotational axis. Into the cylinder holes 31*b* and 32*b*, plungers 26 are inserted. The plunger holder 31 and the plunger disc 32 constitute a cylinder block in which the plural cylinder holes are formed.

The upper end of each plunger 26 becomes a coupling end 26*b* which protrudes upward through an opening 28 provided for a base portion of the rotator 28, and the plunger 26 is energized upward by a spring 27 attached between a flange portion 26*a* and the plunger holder 31. To the coupling end 26*b*, a cam follower 25 is attached, and comes into contact with a cylindrical cam 24 secured to the outer cylinder portion 21.

The rotator 28 is rotation-driven by the motor 22, whereby the plunger holder 31 and the plunger disc 32 rotate, and the plunger 26 rotates together with the plunger holder 31 and the plunger disc 32 about the rotational axis. With this rotation, each plunger 26 reciprocates axially in accordance with the cam shape of the cylindrical cam 24 in synchronization with the rotation of the plunger holder 31 and plunger disc 32. The motor 22 and the cylindrical cam 24 become a plunger drive means which reciprocates the plunger 26 in synchronization with the rotation of the cylinder block. The cam shape of the cylindrical cam 24 is such a shape that three plungers 26 are reciprocated in the predetermined order and at the predetermined timing, whereby suction and ejection of paste, which will be described later, are performed continuously.

Referring to FIG. 3, the plunger disc 32 will be described. The plunger disc 32 is made of hard ceramic such as alumina or hard material such as cemented carbide, and is provided with a cylindrical portion 32*d* extending axially from the outer edge portion of the disc body. For the disc body, the plural cylinder holes 32*b* are provided in the direction of the rotational axis. The upper surface of the disc body becomes a slide surface 32*a* orthogonal to the rotational axis, and the slide surface 32*a* comes into slide-contact with a seal surface 33*a* of a seal disc 33 that is a seal member secured to the outer cylinder portion 21. The cylinder holes 32*b* open at equal intervals on the same circumference of a circle having the rotational axis of the slide surface 32*a* as a center. With an inner surface 32*e* of the cylindrical portion 32*d*, a periphery slide portion 36*a* of an external seal member 36 described later comes into slide contact.

Around the opening of the cylinder hole 32*b*, a scratch-off groove 32*c* is formed. The scratch-off groove 32*c* is used in order to prevent the excessive leakage of paste from the slide-contact surface between the plunger disc 32 and the seal disk 33 by scratching off a particle component in the paste attached onto the seal surface 33*a* in a pumping operation which performs the suction and ejection of paste by rotation of the plunger disc 32 in relation to the seal disc 32.

Referring to FIG. 4, the shape of the seal disc 33 will be described. The seal disc 33 is made of the similar hard material to the material of the plunger disc, and it is a disc member having on its upside a step-like convex portion formed in the shape of a step. An upper surface of the step-like convex portion is the seal surface 33*a* coming into slide-contact with the plunger disc 32, and two circular arc-shaped recess portions 33*b* and 33*c* are formed in the seal surface 33*a*. In the seal disc 33, through-holes 34*a* and 34*b* are formed in two positions on the circumference of a circle at equal intervals, and each of the positions corresponds to the position in the diameter direction of the cylinder hole 32*b*. The through-holes 34*a* and 34*b* communicate respectively with the recess portions 33*b* and 33*c*.

When the plunger disc 32 rotates in a state where the slide surface 32*a* of the plunger disc 32 comes into slide-contact with the seal surface 33*a* of the seal disc 33, the recess portions 33*b* and 33*c* communicate with the opening portions of the cylinder holes 32*b* in the position of the predetermined rotation of the plunger disc 32. Therefore, the recess portions 33*b* and 33*c* function as a first communicating port and a second communicating port which are provided on the seal surface 33*a* and communicate with the opening portions of the cylinder holes 32*b* in the predetermined rotational position of the cylinder block.

An outer surface 33*e* of the step-like convex portion becomes a fitting surface to which an inner fixing portion 36*b* of the external seal member 36 described later fits. A step-like surface 33*f* becomes a seal holding surface which comes into contact with an end surface of the periphery slide portion 36*a* of the external seal member 36 and holds the axial position of the periphery slide portion 36*a*. Further, a periphery edge 33*d* of the seal surface 33*a* is kept in the shape of a sharp edge in which chamfering is not performed, and prevents opening of seal gap from being made in the state where the seal surface 33*a* comes into slide-contact with the slide-contact surface 32*a*, as described later.

In FIG. 2, the plunger holder 31 is provided with a flange portion 31*a* protruding in the diameter direction, and between the flange portion 31*a* and the end surface of the rotator 28, a coned disc spring 30 is attached. The coned disc spring 30, by pressing the plunger holder 31 downward, presses the sliding surface of the plunger disc 32 against the seal surface of the seal disc 33 at the predetermined surface pressure. By this surface pressure, the close attachment between the sliding surface 32*a* and the seal surface 33*a* is secured.

In the state where the plunger disc 32 is brought into slide-contact with the seal disc 33, on the peripheral side of the seal surface 33*a*, a housing portion 37 (refer to FIG. 6) is formed, which is nearly circle ring-shaped space formed by opposing the outer surface 33*e* provided for the seal dick 33 to the inner surface 32*e* of the cylindrical portion 32*d* extending axially from the plunger disc 32. In the housing portion 37, the external seal member 36 is attached.

The external seal member 36, as shown in FIG. 5, is a nearly ring-shaped seal member, which comprises two seal members, that is, an outer slide portion 36*a* and an inner fixing portion 36*b*. The outer slide portion 36*a* is obtained by forming a first seal material of self-lubrication (for example, PTFE (4-fluorinated-ethylene resin)) in the shape of a ring having a rectangular section. Since this seal material has self-lubrication, its coefficient of friction when it comes into slid-contact with and is attached to a seal surface of another member is low, and it is rich in wear-resistance and superior in sliding performance.

For the inner fixing portion 36*b*, an O-ring made of a second seal material (rubber material) that is rich in elasticity is used, and it applies seal surface pressure to the seal surface by the elastic power in the attachment state. On the inner surface of the peripheral slide portion 36*a*, recess portions are provided throughout the entire periphery accordingly to the sectional shape of the inner fixing portion 36*b*, whereby position holding is facilitated when the inner fixing portion 36*b* is combined with the inner surface of the peripheral slide portion 36*a*.

In the state where the external seal member 36 is attached in the housing portion 37, as shown in FIG. 6, the inner fixing portion 36*b* fits to the outer surface 33*e* of the seal disc 33, and an axial end surface on one side of the peripheral slide portion 36*a* comes into contact with the step-like surface 33*f*. Further, the outer surface of the peripheral slide portion 36*a* comes into slide-contact with the inner surface 32*e* of the plunger block 32. In the operating state of the paste ejection apparatus 16, the inner fixing portion 36 is kept fixed to the seal disc 33 by the elastic power, and the peripheral slide portion 36*a* is in the good slide-contact state with the inner surface portion 32*e* of the rotating plunger block 32.

In this operating state, from the seal gap between the seal surface 33*a* and the slide surface 32*a*, the paste leaks into the housing portion 37 a little. The leakage of this paste to the outside of the housing portion 37 is prevented by the external seal member 36. The paste stored in the housing portion 37 at this time acts so as to push the inner fixing portion 36*b* of the external seal 36 to the outer surface 33*e* and push the peripheral slide portion 36*a* to the step-like surface 33*f* and the inner surface 32*e*, whereby the sealing ability of the paste is improved by the external seal member 36. Further, since the peripheral edge 33 of the seal surface

33*a* is sharp edge-shaped as describe before, the paste in the housing portion 37 is difficult to enter into the seal gap, so that opening by the increase of the seal gap is prevented.

The through-holes 34*a* and 34*b* of the seal disc 33 communicate respectively with a first external port 35*a* and a second external port 35*b* which are provided on an end surface of the outer cylinder portion 21. The first external port 35*a* is connected through the tube 20 to the syringe 19 (FIG. 1), and the second external port 35*b* is connected through the tube 17 to the applying nozzle 18 (FIG. 1).

In the state where the through-hole 34 communicates with the cylinder hole 32*b* through the recess portion 33*b*, the plunger 26 moves in the pulling-into direction (upward in FIG. 2), whereby the paste stored in the syringe 19 is supplied through the tube 20 into the cylinder hole 32*b*. The first external port 35*a* is used as a supply port to which the paste supplied from the syringe 19 is introduced.

Next, in the state where the cylinder hole 32*b* that has sucked the paste communicates with the through-hole 34*b* through the recess portion 33*c*, the plunger 26 moves in the pushing-out direction (downward in FIG. 2), whereby the paste in the cylinder hole 32*b* is ejected from the second external port 35*b*. The second external port 35*b* is used as an ejection port from which the paste is ejected to the outside.

Referring next to FIG. 7, the positional relation between the recess portions 33*b*, 33*c* and the cylinder hole 32*bs* in the suction and ejection operations of the paste by the paste ejection apparatus 16 will be described. In the embodiment, by port-switching in which the three plungers 26 are alternately communicated through the recess portion 33*b* or 33*c* that is the communicating port with the two external ports 35*a* and 35*b*, the paste ejection is continuously performed.

Figure 7A:
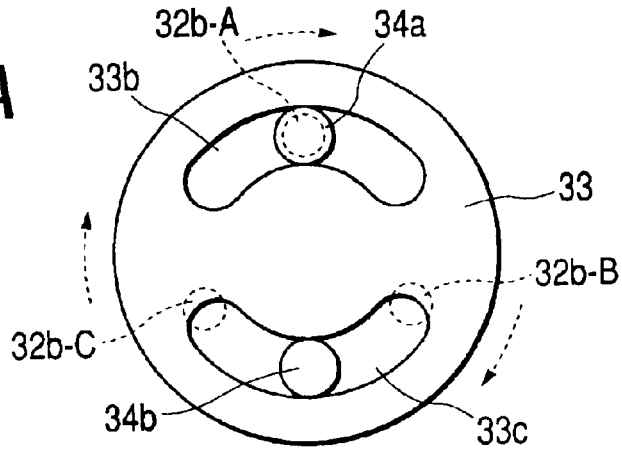
FIG. 7 is a diagram for explaining an operation of the paste ejection apparatus according to the first embodiment of the invention.
Figure 7B:
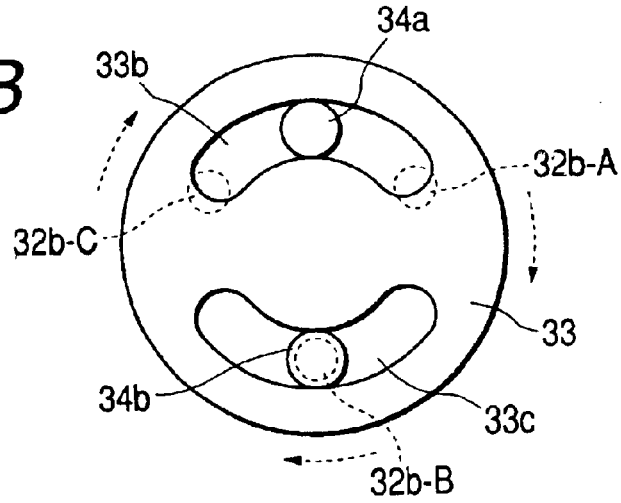

FIG. 7A shows a state where, in a process where the three cylinder holes 32*b*-A, 32*b*-B, and 32*b*-C rotate and move in the direction of an arrow, the position of the cylinder hole 32*b*-A matches with that of the through-hole 34*a*, and supply of the paste to the cylinder hole 32*b*-A is being performed. At this time, the cylinder hole 32*b*-C finishes the ejection of paste and is about to separate from the recess portion 33*c*, and the cylinder 32-B reaches the end portion of the recess portion 33*c* and is about to start the ejection of paste newly. Between the state shown in FIG. 7A and the state shown in FIG. 7B, the supply of paste to the cylinder hole 32*b*-A and the ejection of paste from the cylinder hole 32*b*-B are continuously performed.

Figure 7C:
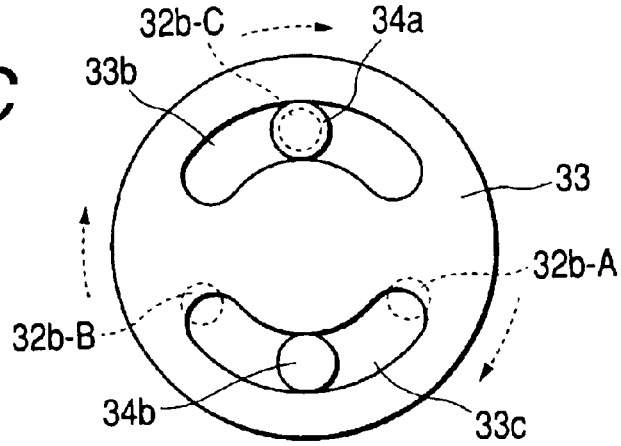

Thereafter, in a timing shown in FIG. 7C, the cylinder hole 32*b*-A reaches the end portion of the recess portion 33*c* and starts the ejection of paste newly. At this time, the cylinder hole 32*b*-B separates from the recess portion 33*c* and finishes the ejection of paste. As described above, any one of the three cylinder holes 32*b* is always in the state of ejecting the paste, whereby the paste is ejected from the external port 35*b* (ejection port) incessantly.

Regarding this paste ejecting operation, also in case that the slurry-like paste including a large amount of filler components and solid particles is used, the paste that has leaked from the seal gap between the seal disc 33 and the plunger 32 is prevented from leaking to the outside by the external seal member 36. Therefore, it is possible to suppress the paste leakage in the paste ejecting operation to the minimum, and a disadvantage that the inside of the apparatus is stained with the paste that has leaked can be prevented.

Second Embodiment

Figure 8:
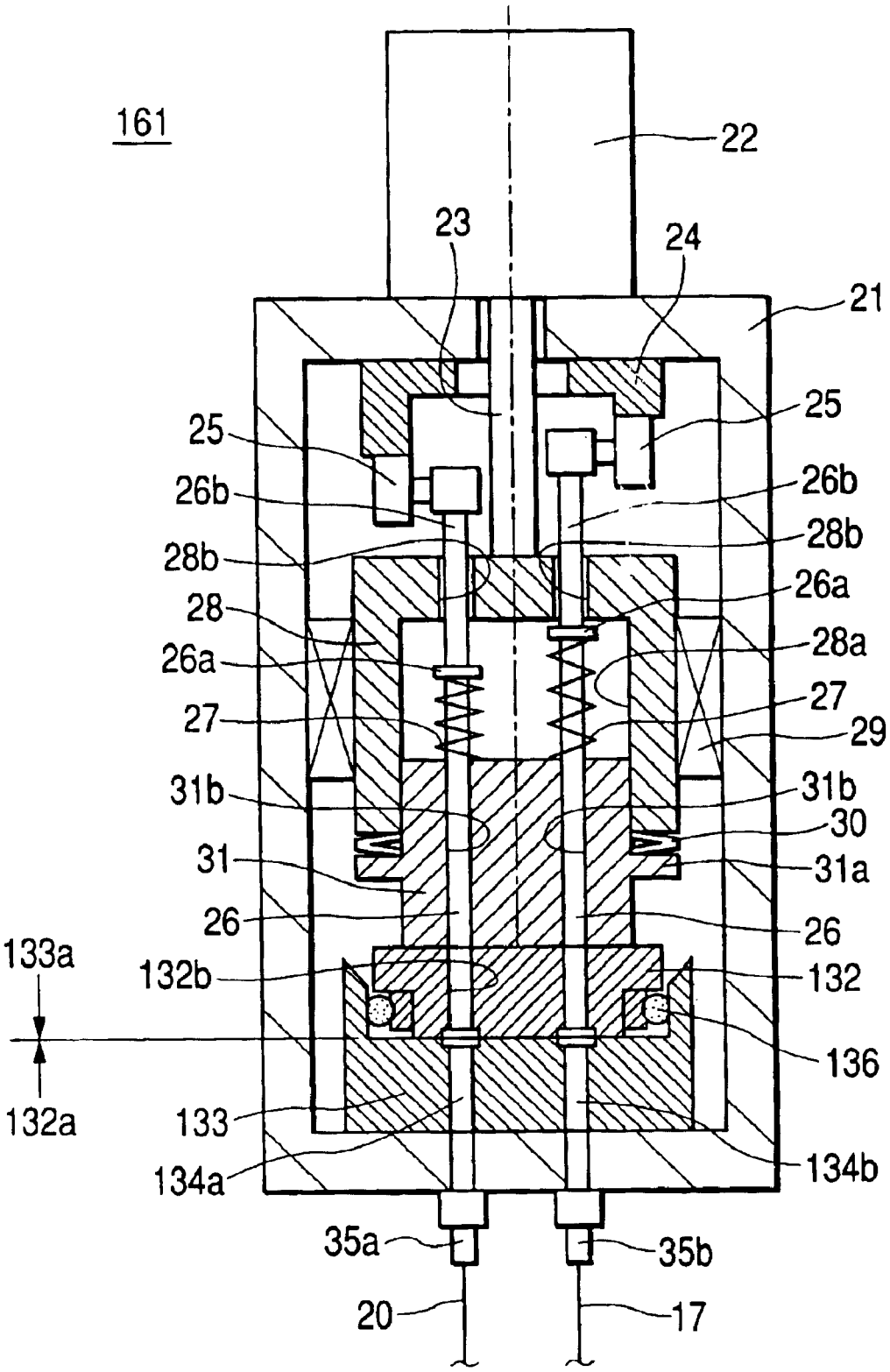
FIG. 8 is a sectional view of a paste ejection apparatus according to a second embodiment of the invention.
Figure 9:
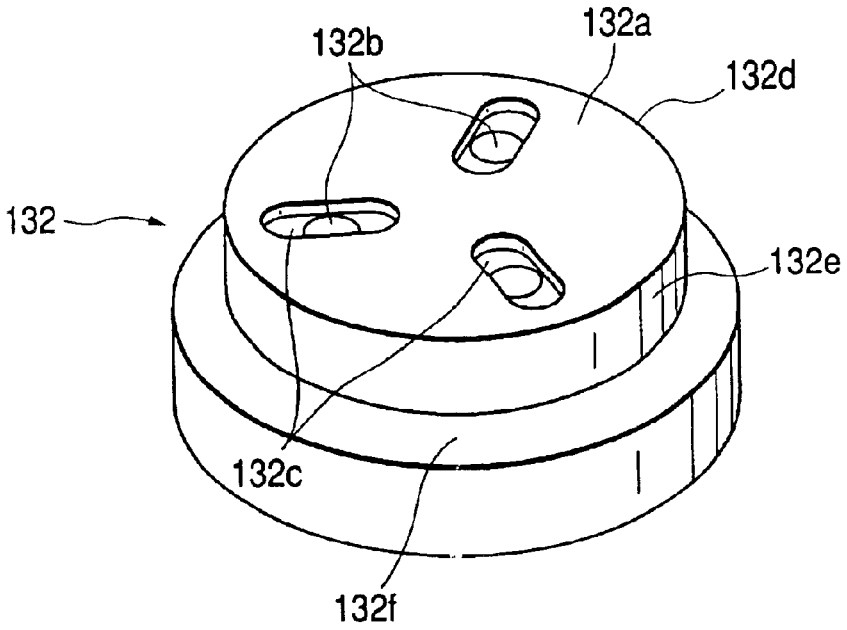
FIG. 9 is a perspective view of a plunger disc of the paste ejection apparatus according to the second embodiment of the invention.
Figure 10:
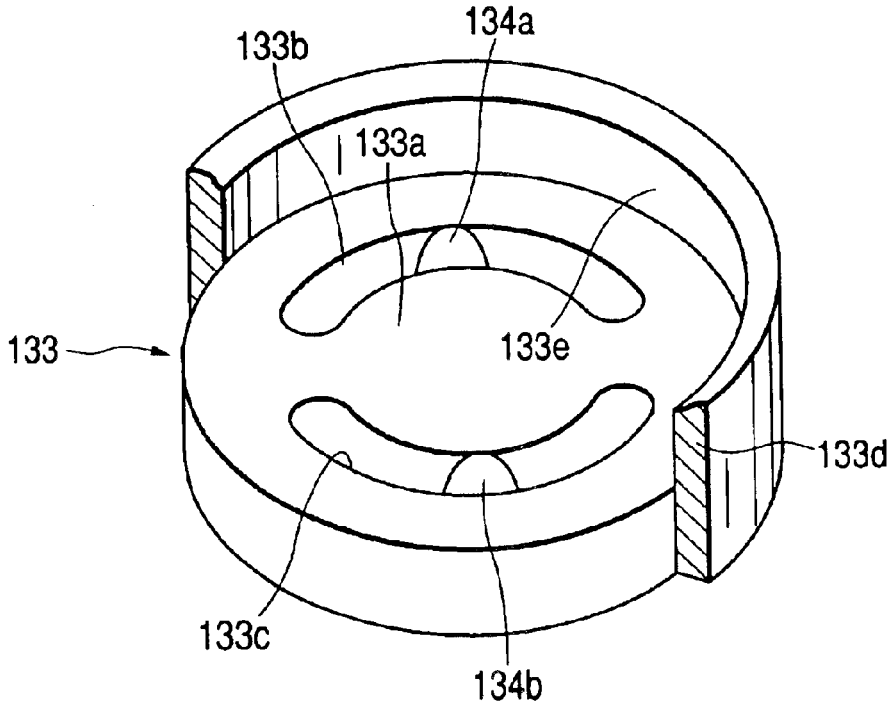
FIG. 10 is a perspective view of a seal disc of the paste ejection apparatus according to the second embodiment of the invention.
Figure 11:
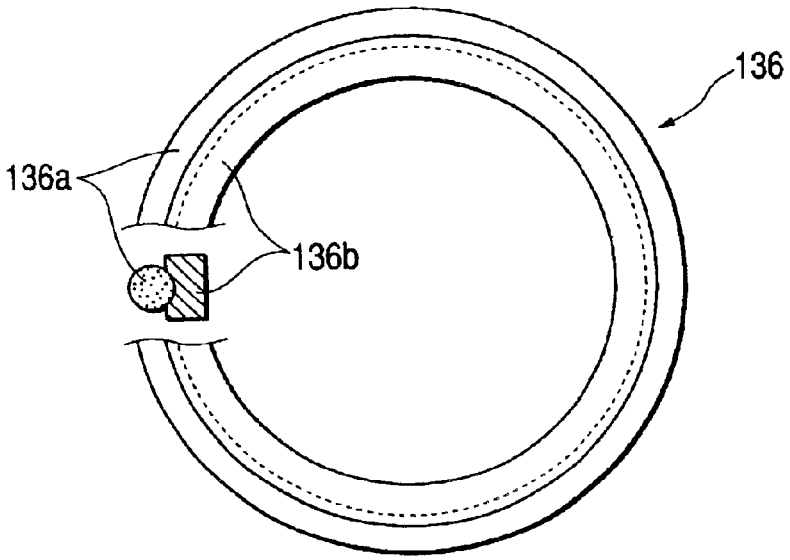
FIG. 11 is a diagram for explaining the shape of an external seal of the paste ejection apparatus according to the second embodiment of the invention.
Figure 12:
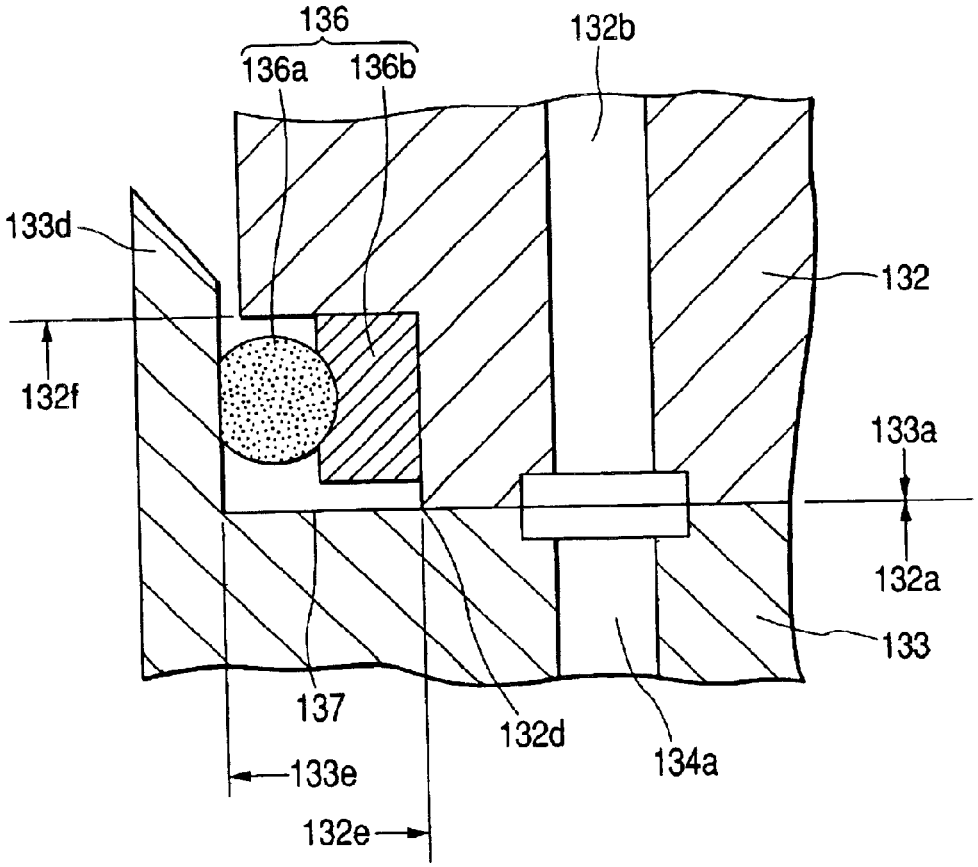
FIG. 12 is a diagram for explaining the attachment state of the external seal of the paste ejection apparatus according to the second embodiment of the invention.

FIG. 8 is a sectional view of a paste ejection apparatus according to a second embodiment of the invention, FIG. 9 is a perspective view of a plunger disc of the paste ejection apparatus according to the second embodiment of the invention, FIG. 10 is a perspective view of a seal disc of the paste ejection apparatus according to the second embodiment of the invention, FIG. 11 is a diagram for explaining the shape of an external seal of the paste ejection apparatus according to the second embodiment of the invention, and FIG. 12 is a diagram for explaining the attachment state of the external seal of the paste ejection apparatus according to the second embodiment of the invention.

In the second embodiment, a modified example of the constitution of the external seal member 36 in the first embodiment is indicated. In FIG. 8, a paste ejection apparatus 161 is provided with the similar paste ejection mechanism to that of the paste ejection apparatus 16 indicated in the first embodiment, and the ejection apparatus in FIG. 8 is different from that in FIG. 2 only in a plunger disc 132, a seal disc 133, and an external seal member 136.

As shown in FIG. 9, a plunger disc 132 is a disc member which is step-shaped and has a convex portion at its upside, and the upper surface of the step-like convex portion becomes a slide surface 132*a* orthogonal to an rotational axis. The slide surface 132*a* comes into slide-contact with a seal surface 133*a* (refer to FIG. 8) of a seal disc 133 that is a seal member fixed to an outer cylinder portion 21. On the slide surface 132*a*, a cylinder hole 132 is opened, which has the same arrangement and the same function as the cylinder hole 32*b* shown in the first embodiment has. Around an opening portion of the cylinder hole 32*b*, a scratch-off groove 32*c* is formed.

An outer surface 132*e* of the step-like convex portion becomes a slide surface with which an inner slide portion 136*b* of an external seal member 136 described later comes into slide-contact. A step-like surface 132*f* becomes a seal holding surface which comes into contact with an end surface of the inner slide portion 136*a* and holds the axial position of the inner slide portion 136*a*. Further, a periphery edge 132*d* of the slide surface 132*a* is kept in the shape of a sharp edge which is not subjected to chamfering, which prevents opening by the increase of the seal gap.

Referring to FIG. 10, the shape of the seal disc 133 will be described. The seal disc 133 is provided with a cylindrical portion 133*d* protruding axially from an outer edge of a disc body, and on the upper surface of the disc body, a seal surface 133*a* coming into slide-contact with the plunger disc 132 is provided. On the seal surface 133*a*, recess portions 133*b* and 133*c* are formed, which have the same arrangement and the same function as the recess portions 33*b* and 33*c* shown in the first embodiment have. With the recess portions 133*b* and 133*c*, through-holes 134*a* and 134*b* communicate respectively. An inner surface 133*e* of the cylindrical portion 133*d* becomes a fitting surface to which a periphery fixing portion 136*a* of the external seal member 136 fits.

In the state where the plunger disc 132 is brought into slide-contact with the seal disc 133, on the peripheral side of the seal surface 133*a*, a housing portion 137 is formed, which is nearly circle ring-shaped space formed by opposing the inner surface 133*e* of the cylindrical portion 133*d* protruding axially from the seal disc 133 to the outer surface 132*e* provided for the plunger disc. In the housing portion 137, the external seal member 16 is attached.

The external seal member 136, as shown in FIG. 11, is a nearly ring-shaped seal member, which comprises two seal members, that is, an outer fixing portion 136*a* and an inner slide portion 136*b*. For the outer fixing portion 136*a*, an O-ring made of a second seal material having the same property and the same function as the inner fixing portion

36*b* shown in the first embodiment has is used. The inner slide portion 136*b* is formed of a first seal material having the same property and the same function as the periphery slide portion 36*a* shown in the first embodiment has, and formed in the shape of a ring having a rectangular section. On the outer surface side of the inner slide portion 136*b*, recess portions are provided throughout the entire periphery accordingly to the sectional shape of the outer fixing portion 136*a*, whereby position holding is facilitated when the outer fixing portion 136*a* is combined with the inner slide portion 136*b*.

In the state where the external seal member 136 is attached in the housing portion 137, as shown in FIG. 12, the inner slide portion 136*b* firstly comes into slide-contact with the outer surface 132*e* of the plunger disc 132, and an axial end surface on one side of the inner slide portion 136*b* comes into contact with the step-like surface 132*f*. Further, the outer surface of the outer fixing portion 136*a* fits to the inner surface 133*e* of a seal block 133.

In the operating state of the paste ejection apparatus 161, the outer fixing portion 136*a* is kept fixed to the inner surface 133*e* of the seal disc 133 by the elastic power, and the inner slide portion 136*b* is in the good slide-contact state with the outer surface 132*e* of the rotating plunger block 32. In this operating state, the paste that has leaked out of the seal gap between the seal surface 133*a* and the slide surface 132*a* is prevented from leaking from the housing portion 137 to the outside by the external seal member 36.

According to the first and second embodiments of the invention, the housing portion which is the circle ring-shaped space, and which is closed and surrounded by the seal member and the cylinder block is provided on the peripheral side of the seal surface between the fixed seal member and the rotating cylinder block; and the nearly ring-shaped external seal member composed of the self lubricant material and the material that is rich in elasticity is attached to this housing member. Hereby, it is possible to prevent the paste that has leaked from the seal surface from leaking to the outside of the housing portion by the external seal member.

Third Embodiment

Figure 13:
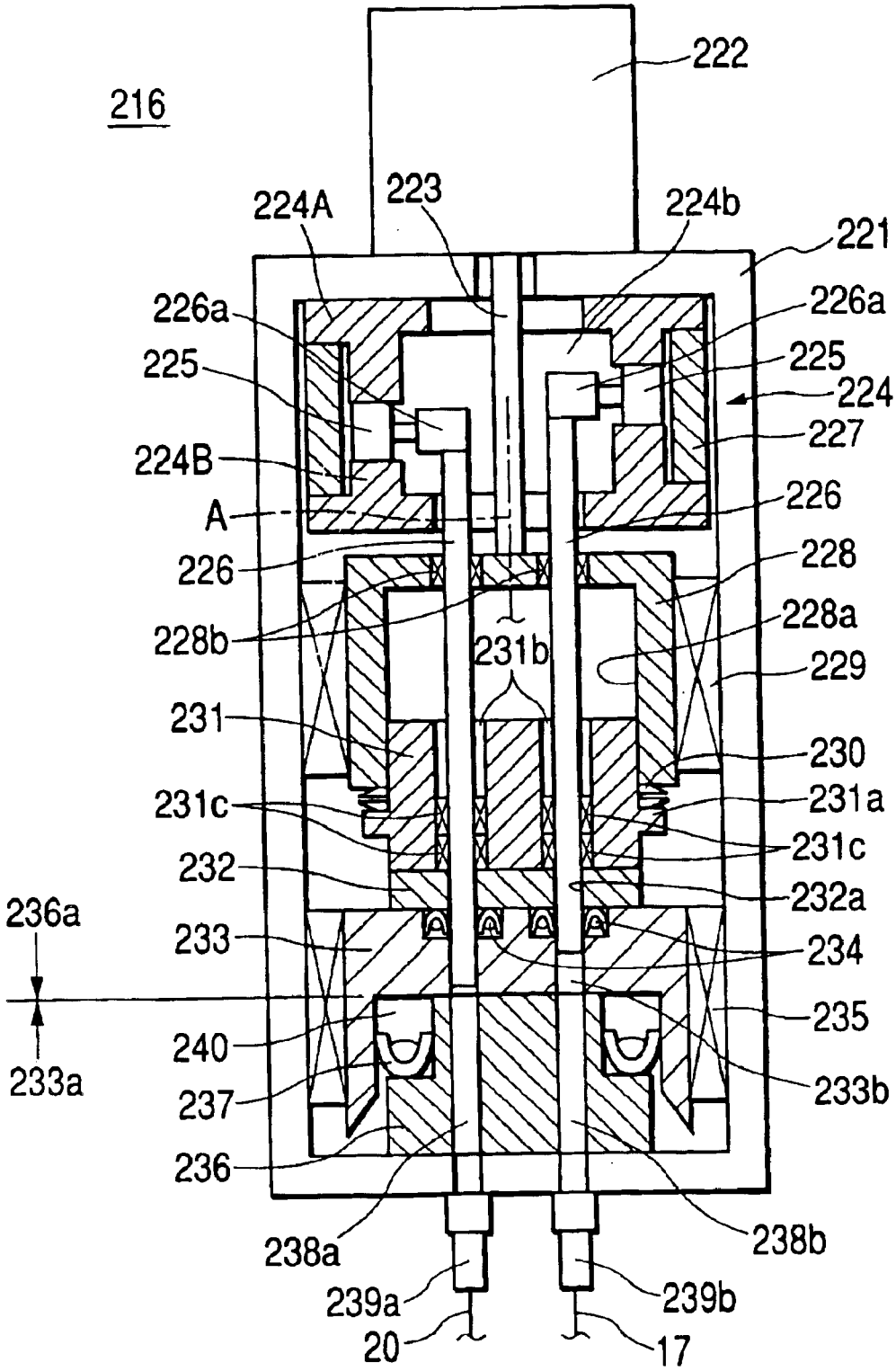
FIG. 13 is a sectional view of a paste ejection apparatus according to a third embodiment of the invention.
Figure 14:
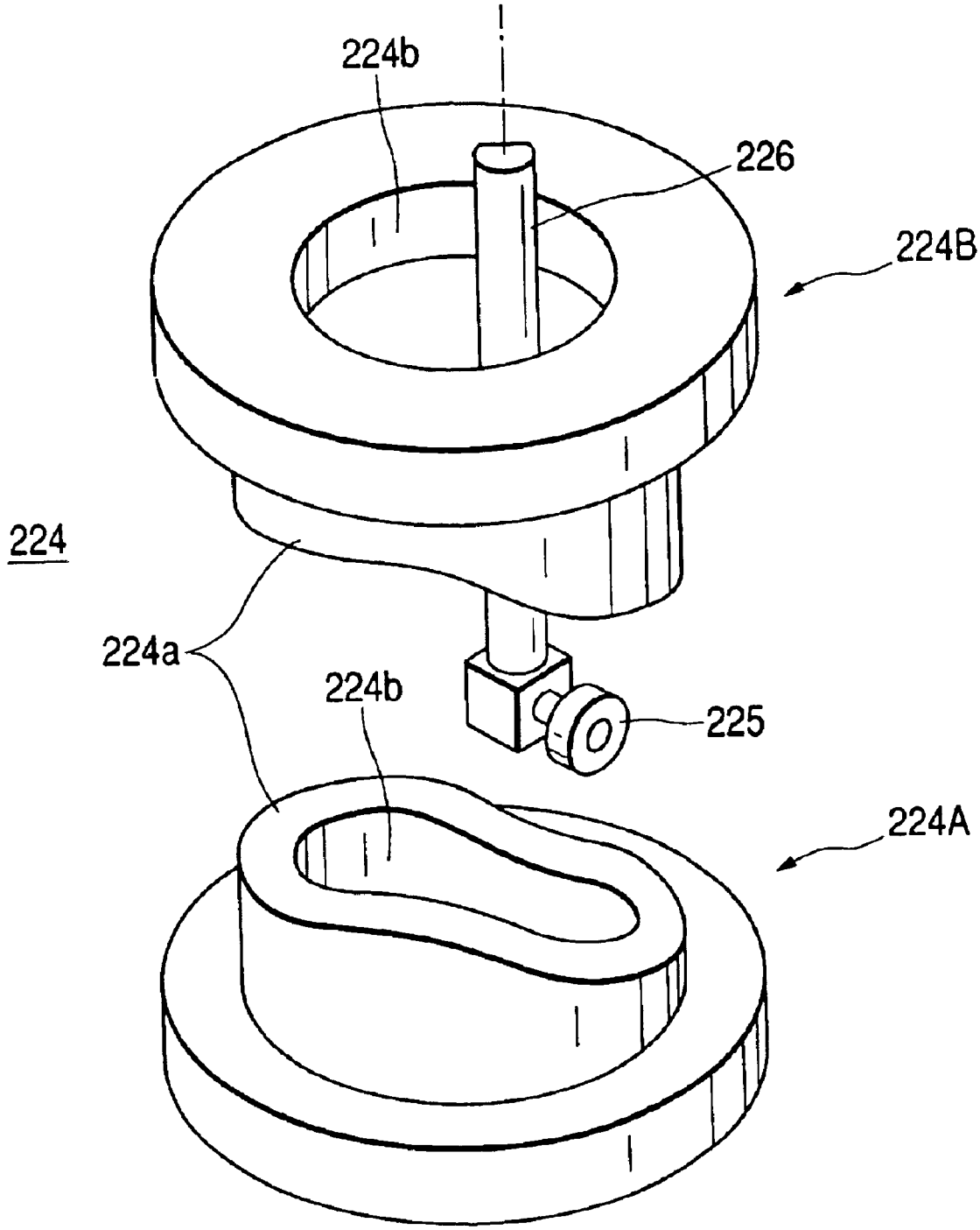
FIG. 14 is a perspective view of a cam portion of the paste ejection apparatus according to the third embodiment of the invention.
Figure 15:
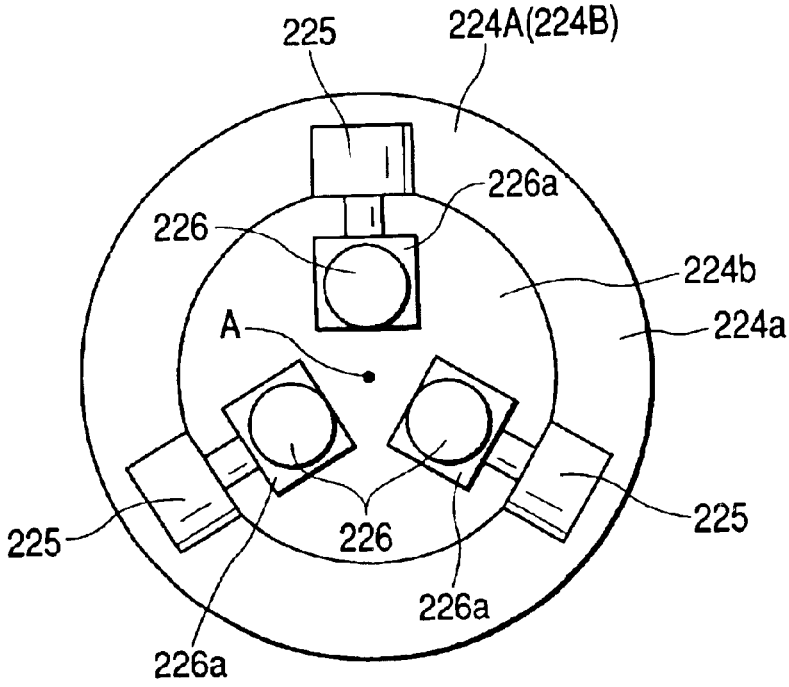
FIG. 15 is a sectional view of the cam portion of the paste ejection apparatus according to the third embodiment of the invention.
Figure 16:
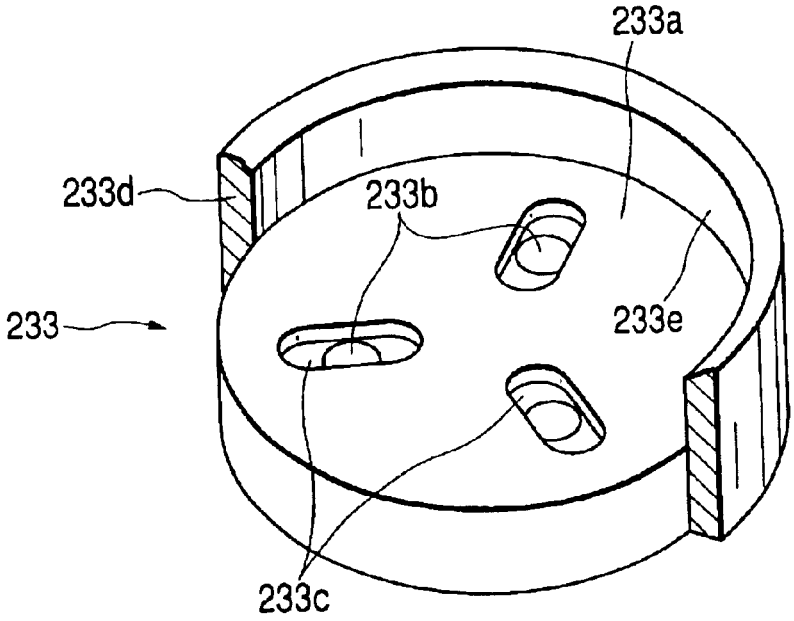
FIG. 16 is a perspective view of a plunger disc of the paste ejection apparatus according to the third embodiment of the invention.
Figure 17:
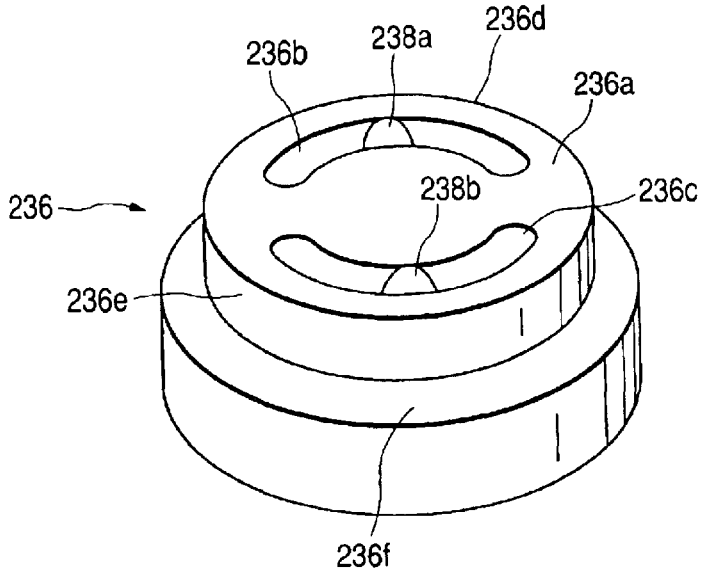
FIG. 17 is a perspective view of a seal disc of the paste ejection apparatus according to the third embodiment of the invention.
Figure 18:
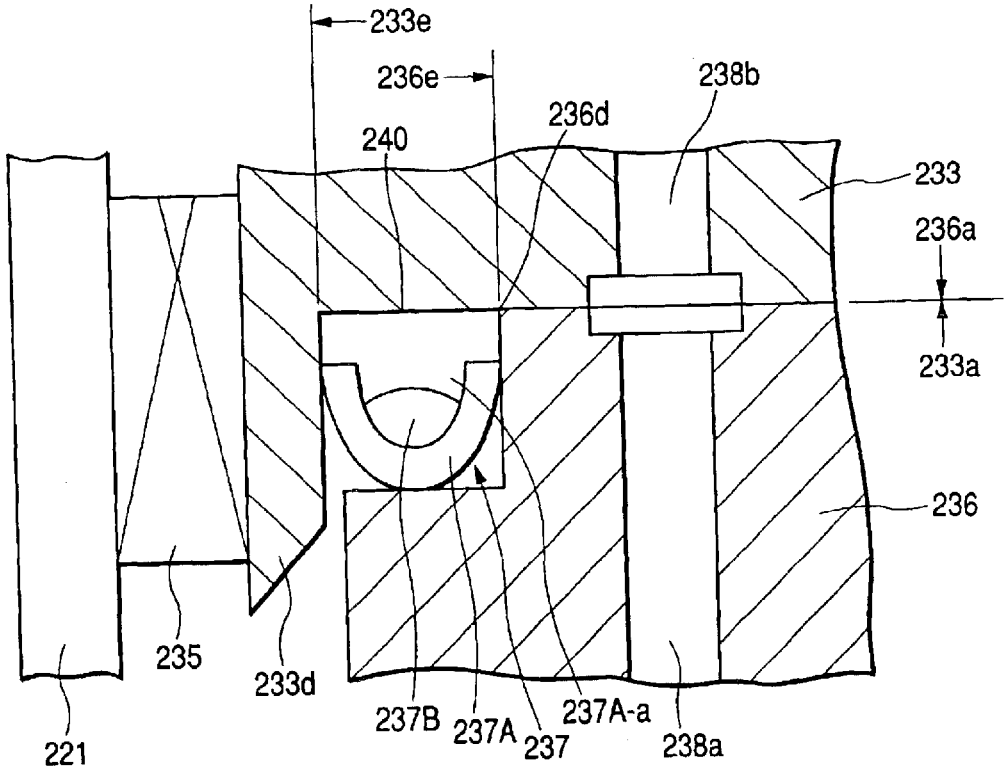
FIG. 18 is a diagram for explaining the attachment state of an external seal of the paste ejection apparatus according to the third embodiment of the invention.

Referring next to drawings, a third embodiment of the invention will be described. FIG. 13 is a sectional view of a paste ejection apparatus according to a third embodiment of the invention, FIG. 14 is a perspective view of a cam portion of the paste ejection apparatus according to the third embodiment of the invention, FIG. 15 is a sectional view of the cam portion of the paste ejection apparatus according to the third embodiment of the invention, FIG. 16 is a perspective view of a plunger disc of the paste ejection apparatus according to the third embodiment of the invention, FIG. 17 is a perspective view of a seal disc of the paste ejection apparatus according to the third embodiment of the invention, FIG. 18 is a diagram for explaining the attachment state of an external seal of the paste ejection apparatus according to the third embodiment of the invention, and FIG. 19 is a diagram for explaining an operation of the paste ejection apparatus according to the third embodiment of the invention.

The third embodiment of the invention shows a modified example of the constitution of the paste ejection apparatus 16 or 161 in the first embodiment 1 or the second embodiment 2. The constitution of other parts is similar to that shown in FIG. 1.

Referring next to FIG. 13, the structure of a paste ejection apparatus 216 will be described. In FIG. 13, the paste ejection apparatus 216 includes in an outer cylinder portion 221 a shaft-type multi-plunger pump which is driven by a motor 222 used as a rotation drive means. To an output shaft 223 of the motor 222, a cylindrical rotator 228 is coupled with an axis A of rotation matched. The rotator 228 is supported by a bearing 229 rotatably, and a plunger holder 231 is attached to an inner diameter portion 228 of the rotator 228. The plunger holder 231 is permitted to slide in the direction of the axis A of rotation in relation to the rotator 228, and receives transmission of the rotation from the rotator 228.

For the plunger holder 231, plural plunger holes 231 are provided in the direction of the axis A of rotation at equal intervals, and a slide bearing 231*c* is attached to each plunger hole 231*b*. To a leading end portion of the plunger holder 231, a plunger disc 233 is secured through a disc-shaped collar plate 232. In the collar plate 232, plural through-holes 232*a* are formed in positions corresponding to the positions of the plunger holes 231*b*. Further, in the plunger disc 233, plural cylinder holes 233*b* are formed in positions corresponding to the positions of the through-holes 232*a*. The outer surface of the plunger disc 233 is slidably held by a cylindrical holding member 235. The holding member 235 is made of material having self-lubrication such as resin or oil retaining metal.

The plunger 226 passes through the slide bearing 231*c*, the through-hole 232*a* and the cylinder hole 233*b* in the state where its movement in the direction of the axis A of rotation is permitted, and a seal member 234 is attached to the upside of the cylinder hole 233*b*. The plunger is inserted into the cylinder hole 233*b* through this seal member 234, and the lower end portion of the plunger 226 reciprocates into the cylinder hole 233*b* thereby to perform the suction and ejection of paste, which will be described later. The plunger holder 231, the collar plate 232, and the plunger disc 233 constitute a cylinder block having the plural cylinder holes 233*b*.

The upper end of each plunger 226 protrudes upward through a slide bearing 228*b* attached to a base portion of the rotator 228 and is coupled to a coupling block 226*a*, and a cam follower 225 is attached to the coupling block 226*a*. Each cam follower 225 reciprocates in the direction of the axis A of rotation by a cam portion 224 described below.

Above the rotator 228, that is, on the motor 222 side of the cylinder block, the cam portion 224 is arranged. The cam portion 224 comprises two end cams (first end cam 224A and second end cam 22B) having cam surfaces 224*a* (refer to FIG. 14) in the direction of an axis A of rotation, the end cams are combined so that their cam surfaces 224*a* are opposed to each other, and registration of the end cams is performed by a spacer member 227 to fit them.

As shown in FIG. 14, either of the first end cam 224A and the second end cam 22B is nearly cylindrical, and inside of each end cam, a cylindrical recess portion 224*b* which the drive end sides of the three plungers 226 inserted into the plunger holder 231 can enter is provided. In the state where the first end cam 224A and the second end cam 224B are opposed to each other and combined, in the inner surface of the cylindrical recess portion 224*b*, a cam groove interposed between the two cam surfaces 224*a* is formed. The drive ends of the three plungers 226 inserted into the plunger holder 231, as shown in FIG. 15, enter the cylindrical recess portion 224*b* in three positions at equal intervals about the axis A of rotation, and the cam follower 225 coupled to the coupling block 226*a* fits to the cam groove.

When the motor 222 is rotation-driven under this state, the cylinder block comprising the plunger holder 231, the collar plate 232, and the plunger disc 233 rotates through the rotator 228, whereby each plunger 226 revolves about the axis A of rotation relatively to the cam portion 224. By this relative rotation, the cam follower 225 fitting to the cam grove rotates and moves into the cam groove along the line of the cam surface, and reciprocates in the direction of the axis A of rotation in accordance with cam characteristic of the cam surface 224*a*. The cam follower 225 transmits this reciprocating movement through the coupling block 226*a* to the plunger 226, whereby while the plunger 226 is rotating about the axis A of rotation, it reciprocates in the direction of the axis A of rotation in synchronization with this rotation.

Namely, the cam groove formed in the inner surface of the cylindrical recess portion 224*b* converts the relative rotating movement of the cylinder block for the cam portion 224 into the reciprocating movement of the plunger 226 in the direction of the axis A of rotation. The motor 222 and the cam portion 224 function as a plunger drive means which reciprocates the plunger 226 in synchronization with the rotation of the cylinder block. The shape of the cam groove provided fro the cam portion 224 is such a shape that the three plungers 226 are reciprocated in the predetermined order and at the predetermined timing, whereby a paste sucking operation and a paste ejecting operation are continuously performed.

In the above constitution, in case of either of the going movement and the returning movement, the plunger 226 is driven by the cam portion 224. Accordingly, by adopting the above constitution as the plunger drive means, slurry-like liquid that is high in viscosity and includes metal powder can be ejected, and the drive power can be transmitted to the plunger surely also in case that the reciprocating movement of the plunger must be performed under the condition of high slide resistance.

Hereby, the problem in the same kind of the conventional apparatus which adopts the general cam mechanism, that is, unsteadiness of operation caused due to high slide resistance in reciprocation of a plunger driven by a cam mechanism which performs a returning operation by the energizing force of a spring is eliminated, so that the stable sucking and ejecting operations can be performed. Further, since the high slide resistance is permitted, a member having high sealing ability can be used for the slide seal portion of the seal member 234, so that the leakage of paste during the operation can be reduced.

Further, in the embodiment, the cam portion 224 which drives the three plungers 226 is constituted so that the cylindrical recess portion 224*b* which the drive end side of each plunger 226 can enter is provided in the cam portion 224, and also the cam groove is formed in the inner surface of the cylindrical recess portion 224*b*. Therefore, as shown in FIG. 15, the three plungers 226 can be arranged closely to one another around the axis A of rotation. Hereby, the paste ejection apparatus which secures high sealing ability, and is small and compact-sized by making the dimension in the diameter direction as small as possible is realized.

Such the constitution of the cam portion 224 is realized readily by opposing the two end cams, the first end cam 224A and the second end cam 224B to each other. Namely, in case that the above cam portion 224 is constituted by an integrated cam member usually used, it is necessary to form a cam groove in an inner surface of a cylindrical recess portion by machining, a parts cost increases because of machining difficulty, and increase of parts size is not avoided due to a limit on machining. On the contrary, in case that the cam portion 224 is constituted by opposing and combining the two end cams, the parts size and the cost can be reduced.

Referring to FIG. 16, the plunger disc 233 will be described. The plunger disc 233 is made of hard ceramic such as alumina or hard material such as cemented carbide, and is provided with a cylindrical portion 233*d* extending axially from the outer edge portion of the disc body. For the disc body, plural cylinder holes 233*b* are provided in the direction of the rotational axis. The upper surface of the disc body becomes a slide surface orthogonal to the rotational axis, and the slide surface comes into slide contact with a seal surface 236*a* of a seal disc 236 that is a seal member secured to the outer cylinder portion 221. The cylinder holes 233*b* open at equal intervals on the same circumference of a circle having the rotational axis of the slide surface 32*a* as a center. With an inner surface 233*e* of the cylindrical portion 233*d*, an external seal member 237 described later comes into slide-contact.

Around the opening portion of the cylinder hole 233*b*, a scratch-off groove 233*c* is formed. The scratch-off groove 233*c* is used in order to prevent the excessive leakage of paste from the slide-contact surface between the plunger disc 233 and the seal disk 236 by scratching off a particle component in the paste attached onto the seal surface 236*a* (refer to FIG. 17) in a pumping operation which performs suction and ejection of paste by rotation of the plunger disc 233 in relation to the seal disc 236.

Referring to FIG. 17, the shape of the seal disc 236 will be described. The seal disc 236 is made of the similar hard material to the material of the plunger disc, and it is a disc member having on its upside a step-like convex portion formed in the shape of a step. An upper surface of the step-like convex portion becomes the seal surface 236*a* coming into slide-contact with the plunger disc 233, and two circular arc-shaped recess portions 236*b* and 236*c* are formed in the seal surface 236*a*. In the seal disc 236, through-holes 238*a* and 238*b* are formed in two positions on the circumference of a circle at equal intervals, and each of the positions corresponds to the position in the diameter direction of the cylinder hole 236*b*. The through-holes 238*a* and 238*b* communicate respectively with the recess portions 236*b* and 236*c*.

When the plunger disc 233 rotates in the state where the slide surface 233*a* of the plunger disc 233 comes into slide-contact with the seal surface 236*a* of the seal disc 236, the recess portions 236*b* and 236*c* communicate with the opening portions of the cylinder holes 233*b* in the position of the predetermined rotation of the plunger disc 233. Therefore, the recess portions 236*b* and 236*c* function as a first communicating port and a second communicating port which are provided on the seal surface 236*a* and communicate with the opening portions of the cylinder holes 233*b* in the predetermined rotational position of the cylinder block.

An outer surface 236*e* of the step-like convex portion becomes a fitting surface to which the external seal member 237 described later fits. A step-like surface 236*f* becomes a seal holding surface which comes into contact with an end surface of the external seal member 237 and holds the axial position of the external seal member 237. Further, a periphery edge 236*d* of the seal surface 236*a* is kept in the shape of a sharp edge which is not subjected to chamfering, and prevents opening of the seal gap from being made in the state where the seal surface 236*a* comes into slide-contact with the slide-contact surface 233*a*, as described later.

In FIG. 13, the plunger holder 231 is provided with a flange portion 231*a* protruding in the diameter direction, and between the flange portion 231*a* and the end surface of the rotator 228, a coned disc spring 230 is attached. The coned disc spring 230, by pressing the plunger holder 231 downward, presses the slide surface of the plunger disc 233 against the seal surface 236*a* of the seal disc 236 at the predetermined surface pressure. By this surface pressure, the close attachment between the slide surface 233*a* and the seal surface 236*a* is secured.

In the state where the plunger disc 233 is brought into slide-contact with the seal disc 236, on the peripheral side of the seal surface 236*a*, a housing portion 240 (refer to FIG. 18) is formed, which is nearly circle ring-shaped space in which the outer surface 236*e* provided for the seal dick 236 is opposed to the inner surface 233*e* of the cylindrical portion 233*d* extending axially from the plunger disc 233. In the housing portion 240, the external seal member 237 is attached.

The external seal member 237 is a nearly ring-shaped seal member, which comprises a first seal material 237A having a V-shaped section and a second seal material 237B held by the first seal material in the interposed state. Namely, the first seal material 237A has a recess portion 237A-a, and the second seal material 237B is held in the recess portion 237A-a. In the state where the external seal member 237 is attached into the housing portion 240, as shown in FIG. 18, the inner surface side of the external seal member 237 fits to the outer surface 236*e* of the seal disc 236, and the outer surface side thereof comes into slide-contact with the inner surface 233*e* of the plunger block 233. The axial end on one side of the external seal member 237 comes into contact with the step-like surface 236*f* (refer to FIG. 17) and the axial position of the external seal member 237 is kept. Further, the first seal material 237A is made of self-lubricant material such as 4-fluorinated ethylene resin, and the second seal material 237B is made of material that is rich in elasticity such as rubber material/spring.

In the operating state of the paste ejection apparatus 216, in which the cylinder block is rotate to reciprocate the plunger 226, from the seal gap between the seal surface 236*a* and the slide surface 233*a*, the paste leaks into the housing portion 240 a little. The leakage of this paste to the outside of the housing portion 240 is prevented by the external seal member 237. The paste stored in the housing portion 240 at this time acts so as to push the external seal 237 to the outer surface 236*e* and the inner surface 233*e*, whereby the sealing ability of the paste is improved by the external seal member 237. Further, since the peripheral edge 236*d* of the seal surface 236*a* is sharp edge-shaped as described above, the paste in the housing portion 240 is difficult to enter into the seal gap, so that opening by the increase of the seal gap is prevented.

In seal of the paste by the external seal member 237, the periphery side of the cylindrical portion 233*d* extending axially from the plunger disc 233 is held slidably by the cylindrical holding member 235 fitted in the outer cylinder portion 221. Therefore, the run-out in the diameter direction of the plunger disc 233 at the rotating time is constrained by the holding member 235. Namely, the holding means 235 functions as a run-out constraining means which constrains the run-out displacement in the diameter direction of the plunger disc 233 in the vicinity of the external seal portion in which the plunger disc 233 constituting the cylinder block and the external seal member 237 come into slide-contact with each other.

Hereby, in slide between the external seal 237 and the inner surface 233*e* with the rotation of the plunger disc 233, the stable sliding state is kept, and the sealing ability of preventing the leakage of paste to the outside is improved. Further, wear of the external seal member 237 in the slide portion is reduced, so that a parts life can be elongated.

In FIG. 13, the through-holes 238*a* and 238*b* of the seal disc 236 communicate respectively with a first external port 239*a* and a second external port 239*b* which are provided on an end surface of the outer cylinder portion 221. The first external port 239*a* is connected through the tube 20 to the syringe 19 (FIG. 1), and the second external port 239*b* is connected through the tube 17 to the applying nozzle 18 (FIG. 1).

In the state where the through-hole 238*a* communicates with the cylinder hole 233*b* through the recess portion 236*b*, the plunger 226 moves in the pulling-into direction (upward in FIG. 13), whereby the paste stored in the syringe 19 is supplied through the tube 20 into the cylinder hole 233*b*. The first external port 239*a* functions as a supply port to which the paste supplied from the syringe 19 is introduced.

Next, in the state where the cylinder hole 233*b* from which the paste has been sucked communicates with the through-hole 238*b* through the recess portion 236*c*, the plunger 226 moves in the pushing-out direction (downward in FIG. 13), whereby the paste in the cylinder hole 233*b* is ejected from the second external port 239*b*. The second external port 239*b* functions as an ejection port from which the paste is ejected to the outside Referring next to FIG. 19, the positional relation between the recess portions 233*b*, 23*c* and the cylinder holes 233*b* in the sucking and ejecting operations of the paste by the paste ejection apparatus 216 will be described. In the embodiment, by port switching in which the three plungers 226 are communicated through the recess portion 236*b* or 236*c* that is the communicating port with the two external ports 239*a* and 239*b* alternately, the paste ejection is continuously performed.

Figure 19A:
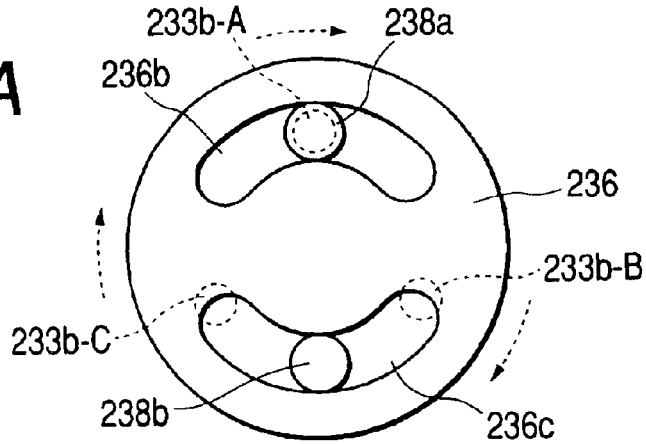
FIG. 19 is a diagram for explaining an operation of the paste ejection apparatus according to the third embodiment of the invention.
Figure 19B:
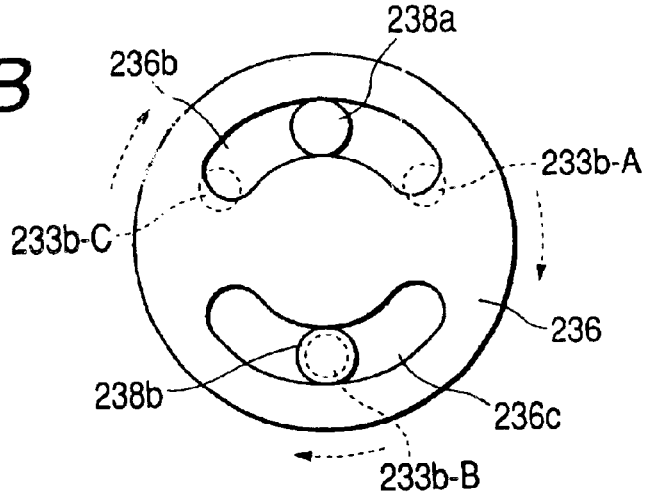

FIG. 19A shows a state where, in a process where the three cylinder holes 233*b*-A, 233*b*-B, and 233*b*-C rotate and move in the direction of an arrow, the position of the cylinder hole 233*b*-A matches with that of the through-hole 238*a*, and supply of the paste to the cylinder hole 233*b*-A is being performed. At this time, the cylinder hole 233*b*-C finishes the ejection of paste and is about to separate from the recess portion 236*c*, and the cylinder 233-B reaches the end portion of the recess portion 236*c* and is about to start the ejection of paste newly Between the state shown in FIG. 19A and the state shown in FIG. 19B, the supply of paste to the cylinder hole 233*b*-A and the ejection of paste from the cylinder hole 233*b*-B are continuously performed.

Figure 19C:
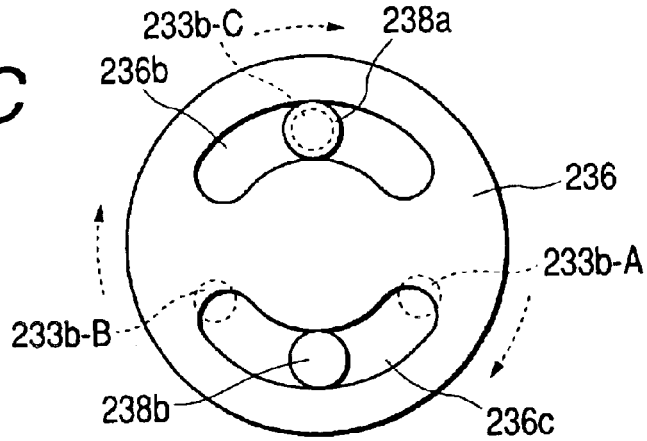

Thereafter, in a timing shown in FIG. 19C, the cylinder hole 233*b*-A reaches the end portion of the recess portion 236*c* and starts the ejection of paste newly. At this time, the cylinder hole 233*b*-B separates from the recess portion 236*c* and finishes the ejection of paste. As described above, any one of the three cylinder holes 233*b* is always in the state of ejecting the paste, whereby the paste is ejected from the external port 239*b* (ejection port) incessantly.

Regarding this paste ejecting operation, also in case that the slurry-like paste including a large amount of filler components and solid particles is used, the paste that has leaked from the seal gap between the seal disc 236 and the plunger 233 is prevented from leaking to the outside by the external seal member 237. Therefore, it is possible to suppress the paste leakage in the paste ejecting operation to the minimum, and a disadvantage that the inside of the apparatus is stained with the paste that has leaked can be prevented.

Further, the constitution shown in the third embodiment can be applied to the first embodiment or the second embodiment. Similarly, the external seal member shown in the first embodiment or the second embodiment can be applied to the third embodiment.

What is claimed is:

1. A paste ejection apparatus for ejecting slurry-like paste in which a viscous substance and a filler component are mixed, comprising:

a cylinder block being rotatable about a rotational axis by a rotation drive means, and contacting slidably with a seal surface of a seal member through a slide surface orthogonal to the rotational axis;

plural cylinder holes provided in the direction of the rotational axis of the cylinder block and including opening portions formed at equal intervals on the same circumference of a circle having the rotational axis of the slide surface as a center;

a plunger inserted into each cylinder hole;

a plunger drive means reciprocating said plunger in synchronization with the rotation of said cylinder block;

first and second communicating ports provided on the seal surface and communicating with the opening portions of the cylinder holes in the predetermined rotary position of the cylinder block;

first and second external ports communicating respectively with the first and second communicating ports through the seal member;

a housing portion located on the peripheral side of the seal surface, closed and surrounded by the seal member and the cylinder block to be a circular ring-shaped space; and a ring-shaped external seal member attached into the housing portion, including a first seal material having self-lubrication and a second seal material being rich in elasticity.

2. The paste ejection apparatus according to claim 1, wherein the housing portion is formed by opposing an outer surface of the seal member to an inner surface extending axially from the cylinder block.

3. The paste ejection apparatus according to claim 2, wherein the second seal material of the external seal member is fitted onto the outer surface of the seal member, and the first seal member of the external seal member slidably contacts with the inner surface of the cylinder block.

4. The paste ejection apparatus according to claim 2, wherein the first seal member has a recess portion, and the second seal member is held by the recess portion of the first seal member.

5. The paste ejection apparatus according to claim 1, wherein the housing portion is formed by opposing an inner surface extending axially from the seal member to an outer surface of cylinder block.

6. The paste ejection apparatus according to claim 5, wherein the first seal member of the external seal member slidably contacts with the outer surface of the cylinder block, and the second seal material of the external seal member is fitted onto the inner surface of the seal member.

7. The paste ejection apparatus according to claim 5, wherein the first seal member has a recess portion, and the second seal member is held by the recess portion of the first seal member.

8. A paste ejection apparatus for ejecting slurry-like paste in which a viscous substance and a filler component are mixed, comprising:

a cylinder block being rotatable about a rotational axis by a rotation drive means, and contacting slidably with a seal surface of a seal member through a slide surface orthogonal to the rotational axis;

plural cylinder holes provided in the direction of the rotational axis of the cylinder block and including opening portions formed at equal intervals on the same circumference of a circle having the rotational axis of the slide surface as a center;

a plunger inserted into each cylinder hole;

a plunger drive means reciprocating said plunger in synchronization with the rotation of said cylinder block;

first and second communicating ports provided on the seal surface and communicating with the opening portions of the cylinder holes in the predetermined rotary position of the cylinder block;

first and second external ports communicating respectively with the first and second communicating ports through the seal member;

a housing portion located on the peripheral side of the seal surface, closed and surrounded by the seal member and the cylinder block to be a circular ring-shaped space;

a ring-shaped external seal member attached into this housing portion; and a run-out constraining means for constraining run-out displacement in the diameter direction of the cylinder block near the external seal portion slidably contacts with the cylinder block.

9. The paste ejection apparatus according to claim 8, wherein the housing portion is formed by opposing an outer surface of the seal member to an inner surface extending axially from said cylinder block;

the inner surface side of the external seal member is fitted onto the outer surface of the seal member; and the outer surface side of the external seal member slidably contacts with the inner surface of the cylinder block.

10. A paste ejection apparatus for ejecting slurry-like paste in which a viscous substance and a filler component are mixed, comprising:

a cylinder block being rotatable about a rotational axis by a rotation drive means, and contacting slidably with a seal surface of a seal member through a slide surface orthogonal to the rotational axis;

plural cylinder holes provided in the direction of the rotational axis of the cylinder block and including opening portions formed at equal intervals on the same circumference of a circle having the rotational axis of the slide surface as a center;

a plunger inserted into each cylinder hole;

a plunger drive means reciprocating said plunger in synchronization with the rotation of said cylinder block;

first and second communicating ports provided on the seal surface and communicating with the opening portions of the cylinder holes in the predetermined rotary position of the cylinder block; and first and second external ports communicating respectively with the first and second communicating ports through the seal member;

wherein the plunger drive means includes;

a cam portion provided on the rotation drive means side of the cylinder block, and having cylindrical recess portions formed so that the drive end sides of the plural plungers can enter therein;

a cam groove formed on the inner surface of said cylindrical recess portion and converting the relative rotating movement for the cam portion of said cylinder block into the reciprocating movement of the plunger in the direction of the rotational axis; and a cam follower coupled to the drive end side of each of the plural plungers, and rotating and moving into the cam groove thereby to transmit the reciprocating movement to the plunger.

11. The paste ejection apparatus according to claim 10, wherein the cam portion is constituted by combining two end cams each having a cam surface in the direction of the rotational axis in a state where the cam surfaces are opposed to each other.

* * * * *